US005901880A

United States Patent [19]

Clarke

[11] Patent Number: 5,901,880

[45] Date of Patent: May 11, 1999

[54] BOTTLED WATER DELIVERY SYSTEM

[76] Inventor: Peter C. Clarke, 961 Old Arlington Ct., Buffalo Grove, Ill. 60089

[21] Appl. No.: 08/748,596

[22] Filed: Nov. 13, 1996

[51] Int. Cl.[6] ..... B67D 5/08

[52] U.S. Cl. ..... 222/63; 222/66; 222/67; 222/333

[58] Field of Search ..... 222/63, 64, 65, 222/66, 67, 333

[56] References Cited

U.S. PATENT DOCUMENTS

| | | | |
|---|---|---|---|
| 3,408,053 | 10/1968 | Vantroba | 222/67 |
| 4,030,634 | 6/1977 | Osborn | 222/64 X |
| 4,456,149 | 6/1984 | Sciortino | 222/63 X |
| 4,852,621 | 8/1989 | Bear | 141/83 |
| 4,987,746 | 1/1991 | Roberts | 62/137 |
| 5,540,355 | 7/1996 | Hancock et al. | 222/63 X |
| 5,558,256 | 9/1996 | Miller et al. | 222/63 X |
| 5,638,991 | 6/1997 | Todden et al. | 222/113 |

*Primary Examiner*—Kevin P. Shaver
*Attorney, Agent, or Firm*—Kajane McManus

[57] ABSTRACT

The bottled water delivery system includes a pump which moves water from within a bottle to a desired output location. The system is such that heavy water bottles need not be moved and may be located at a significant preselected distance from the output location. A controller is provided to keep the pump from being actuated when there is no water available for pumping. The system is easily installed, inexpensive due to its simplicity, and requires a minimal input of power for operation.

15 Claims, 1 Drawing Sheet

BOTTLED WATER DELIVERY SYSTEM

BACKGROUND OF THE INVENTION

1. Field of the Invention

The present invention relates to a system for delivering water from a bottle to a chosen output, such as an icemaker of a refrigerator. More particularly, the system is inexpensive, is simple, is self-priming, is easily engageable to the source and output, requires no moving of full water bottles, and allows the source to be placed at a significant distance from the output.

2. Prior Art

Heretofore, various complex systems have been proposed for use in delivering water from a bottle to an output such as an icemaker, a coffee making apparatus, a water dispensing system, etc. Such systems have often required pressurization of the water in a water bottle, or have required priming whenever water bottles are changed, or, have required the water bottle to be positioned near the desired output, or have required venting of the water bottle.

Examples of such complex systems are found in the following U.S. Patents:

| U.S. Pat. No. | Patentee |
|---|---|
| 3,653,413 | Sheya |
| 4,027,499 | Barto et al |
| 4,030,634 | Osborn |
| 4,226,267 | Meacham, Jr. |
| 4,852,621 | Bear |
| 4,928,856 | White |
| 4,987,746 | Roberts |
| 5,042,689 | Mrugala et al |
| 5,111,966 | Fridman |
| 5,328,059 | Campbell |
| 5,349,992 | Gallo et al |
| 5,405,052 | Sawyer, III |

As will be described in greater detail hereinafter, these systems are complex, not easily engageable, and are inherently more expensive than the system disclosed herein. Further, none provides for the source and output being spaced apart by any appreciable distance.

SUMMARY OF THE INVENTION

According to the invention there is provided a system for delivering water from a bottle to a desired output location, the system comprising a demand pump to which fluid is drawn via a first conduit from the bottle and from which fluid is pumped via a second conduit to the output location on demand, a controller for the pump which is operatively engaged to a water level sensor and to the pump in a manner to allow pump activity only when the water level sensor senses the presence of a predefined level of water, the system being further connected to a source of power and being of low amperage.

DESCRIPTION OF THE PREFERRED EMBODIMENT

Figure 1:
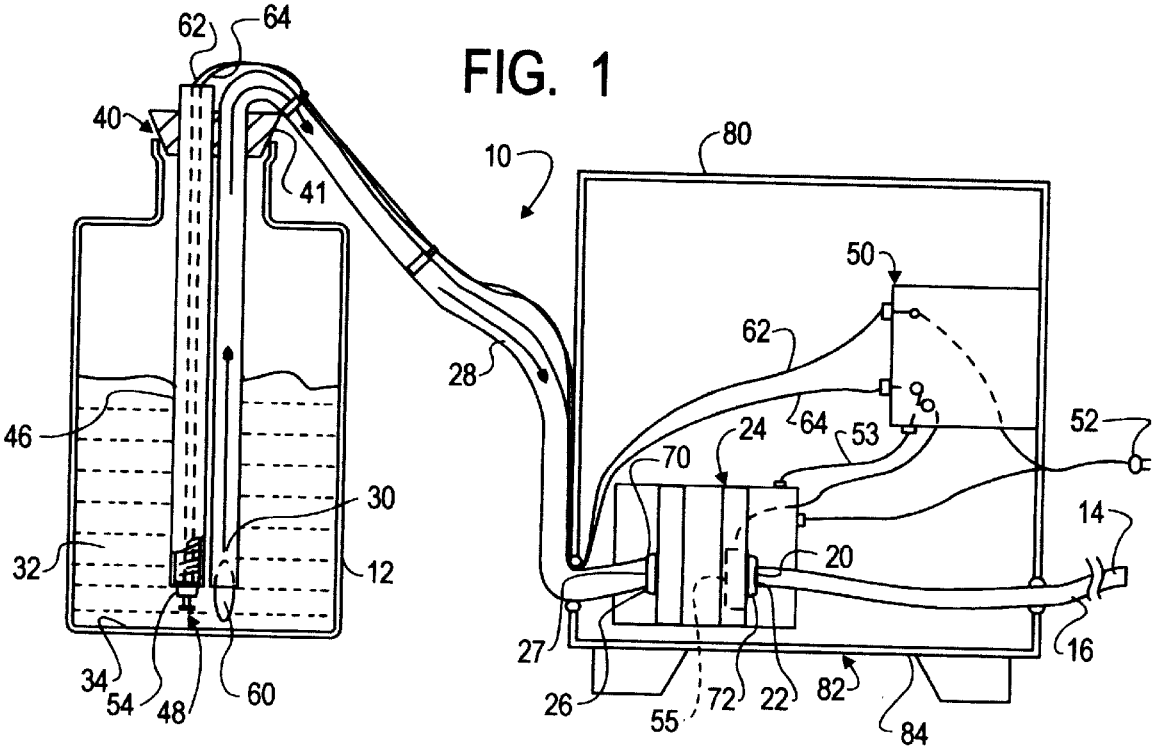
FIG. 1 is a perspective view of a preferred embodiment of the invention.
Figure 2:
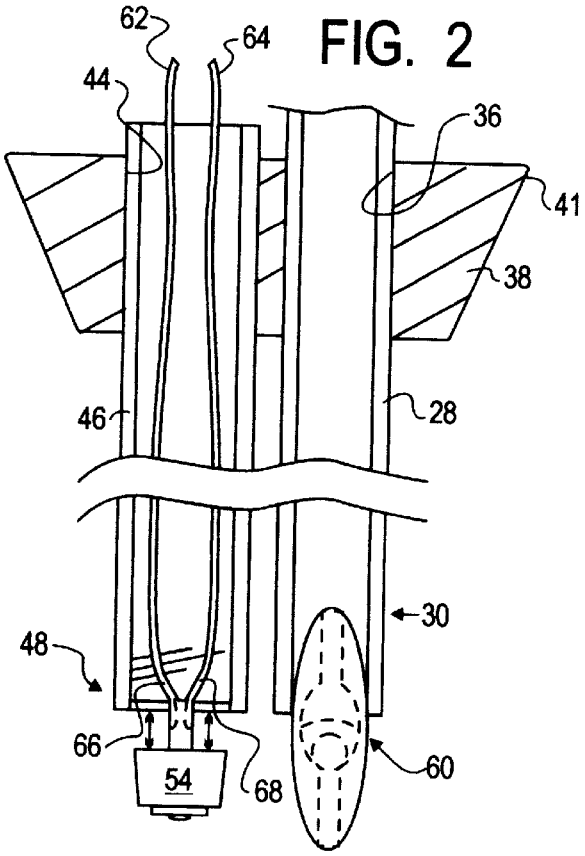
FIG. 2 is an enlarged view of the submersible ends of the water intake tube and the water level sensor of the system.

Referring now to the drawings in greater detail, there is illustrated therein the bottled water delivery system made in accordance with the teachings of the present invention and generally identified by the reference numeral 10.

Figure 3:
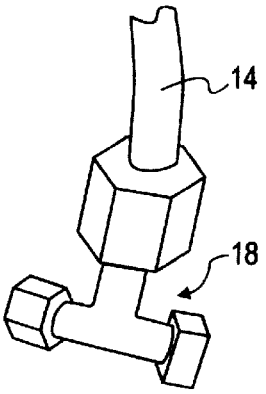
FIG. 3 is an enlarged view of a free end of a water outflow tube of the system showing same engaged to a splitter for use in serving more than one output.

The system 10 is used to transport water from a source, such as a water bottle 12 to a free end 14 of an outflow conduit or tube 16, which may be connected, for example, to an icemaker of a refrigerator (not shown) or which can, as illustrated in FIG. 3, be attached to a splitter 18 for supplying water to a plurality of chosen locations.

An upstream end 20 of the outflow tube 16 is engaged to an outlet 22 of a pump 24. The pump 24 also includes an inlet 26 to which one end 27 of a water intake conduit or tube 28 is engaged. A free end 30 of the water intake tube 28 is submersed within water 32 in the bottle 12, and is positioned to rest just above a bottom surface 34 of the bottle 12. Positioning of the intake tube 28 is maintained by frictionally engaging the tube 28 within a port 36 formed in a cap or plug 38 which removably engages within a neck opening 40 of the bottle 12. The plug 38 includes a graspable rim or flange 41 which makes plug 38 disengaged from and engagement to the neck opening 40, easy.

The cap or plug 38 further includes a second port 44 therein which frictionally engages a rigid tube 46 having a float mechanism 48 thereon which is submersed to a position slightly above or at the level at which intake tube 28 terminates.

Float mechanism 48 is used to control energization capability of the pump 24 so that the pump 24 will not turn on when the water level in the bottle 12 drops to near empty. By keeping the pump 24 from being operable when the bottle 12 is empty, the system 10 requires no priming because air never enters the system 10.

Control for the pump 24 is provided through use of a generic controller 50. The controller 50 is frictionally engaged to a source of current, such as by a wall plug 52, or, alternatively may be connected to a source of DC current (not shown).

The controller 40 is further connected to the pump 24 so that power to the pump 24 is provided through the controller 50 via a line 53.

Still further, the controller 50 is electrically connected to the float mechanism 48 in a manner such that, when a float 54 of the float mechanism 48 is elevated, a complete circuit is created and the pump 24 will operate as necessary. On the other hand, when the float 54 drops away from its elevated position, the circuit is broken and the pump 24 cannot be actuated.

The preferred embodiment for the pump 24 is in the form of a duplex diaphragm demand pump 24 which includes a built in pressure sensing switch 55, with the pressure low at which the pump 24 is to activate being a settable parameter.

When pressure in the outflow tube 16 drops to a predetermined level, the pump 24, if the float 54 is elevated to form a complete circuit, is activated to supply water to the outlet 14, such pressure drop being created when a demand for water is placed on the system 10.

When a water bottle 12 is empty, one merely unseats the plug or cap 38 from the empty bottle 12 and repositions same into a full water bottle 12. No moving of water bottle 12 is required.

Also, in the disclosed embodiment, the particular pump 24 used to create a prototype of the system 10 provides a maximum flow of 1.01 gallons per minute with a 60 psi maximum pressure. Such prototype has been installed with the bottles 12 and pump 24 being approximately 15–20 feet below an icemaker intake, and approximately 20 feet laterally away from the icemaker intake. Thus, the system 10 has been found to provide water from a bottle 12 as far as 40 feet away from the final destination for the water.

Obviously, a stronger pump 24 may be used to provide an increased flow or to accommodate a greater distance of travel.

Also, to keep water from exiting the intake tube 28 during transference of the tube 28 from an empty bottle 12 to a full bottle 12, a one way check valve 60 may be provided on the end 30 of the tube 28 which closes off the tube 28 when no water flowing thereinto from the bottle 12.

Rigid tube 46 includes a pair of wires 62, 64 therein which originate within and create contacts for the controller 50 and terminate at isolated contact points 66 and 68, respectively near the end of the tube 46 incorporating the float mechanism 48. When the float 54 thereof is elevated, the isolated contact points are bridged by the float 54, producing a complete circuit and allowing energization of the pump 24. In a preferred embodiment, the float mechanism 48 only has a 0.15 amp draw, making accidental contact with the wires 62, 64 thereof essentially harmless.

Also, the pump 24 only has a 0.5 amp draw and the controller 50 may be of low amp draw as well.

Further, the pump 24 is preferably of the type that may run dry without damage. Also, for aesthetics and simplicity, the pump 24 and controller 50 may be mounted within a housing 80.

It will be understood that appropriate fittings 70 and 72 are used to engage the tubes 28 and 16 to the pump 24, ports 26 and 22, respectively, in known manner. Also, if the system 10 is provided with a 0.25 inch O.D. outflow tube 16, direct connection to a refrigerator water supply line is easily accomplished without need of accessory fittings.

Further, the pump 24 in the preferred embodiment will produce a pulseless flow unless a pulsed flow is required by the output device to which the system is engaged.

Still further, it is proposed to mount the controller 50 and related wiring at a level above the pump 24 so that, should a water leak develop, the wiring in the housing 80 will be above the level of the water.

The housing 80 is preferably provided with a drain port 82 in a bottom wall 84 thereof and it is preferable to maintain the conduits or tubes 16 and 28 as close as possible to the bottom wall 84 of the housing 80, as illustrated.

As described above, the system 10 provides a number of advantages, some of which have been described above and others of which are inherent in the invention. Also modifications may be proposed to the system 10 without departing from the teachings herein. Accordingly the scope of the invention is only to be limited as necessitated by the accompanying claims.

I claim:

1. A system for delivering water from a bottle to a desired output location, the system consisting essentially of a pump to which fluid is drawn via a first conduit from the bottle and from which fluid is pumped via a second conduit to the output location, a water level sensor positioned within the bottle, a pressure sensing switch built into the pump for sensing pressure within the second conduit and a controller for the pump operatively engaged to the water level sensor, to the pressure sensing switch, and to the pump, the pump being operable in response to a sensed change in pressure in the second conduit only when the water level sensor senses the presence of a predefined level of water, the system being further connected to a source of power and being of low amperage.

2. The system of claim 1 wherein said pump is a duplex diaphragm pump and wherein the switch responds to a sensed drop in pressure in the second conduit by activating the pump when the water is sensed to be above a predefined level.

3. The system of claim 1 wherein said first conduit incorporates a one way check valve at a free end thereof.

4. The system of claim 1 wherein said second conduit has a free output end.

5. The system of claim 4 wherein said free output end of said second conduit is engaged to a splitter for use in providing more than one output.

6. The system of claim 1 wherein said water level sensor comprises a float.

7. The system of claim 6 wherein said float is part of a float mechanism which includes first and second isolated wires, the float bridging a gap between the wires and creating a closed circuit across the wires when in a raised position thereof.

8. The system of claim 7 wherein an open circuit is created when the float drops due to a water level below a predefined minimum level.

9. The system of claim 8 wherein said first wire engages a source of power at a free end thereof.

10. The system of claim 9 wherein said second wire engages a power input of the pump.

11. The system of claim 10 wherein said first and second wires are encased in a rigid tube.

12. The system of claim 11 including a water bottle plug having two ports therein.

13. The system of claim 12 wherein said first conduit extends a predetermined distance from said plug into said bottle and has a free end which rests just above a bottom surface of said bottle.

14. The system of claim 12 wherein said tube and said first conduit are each frictionally engaged in and extend through a water bottle plug port.

15. The system of claim 14 wherein said tube extends to a position where said float thereof is at or above the level of the conduit free end.

* * * * *